US012252880B2

(12) United States Patent
Scherrer et al.

(10) Patent No.: US 12,252,880 B2
(45) Date of Patent: Mar. 18, 2025

(54) SYSTEM AND METHOD FOR INSULATING AN INTERMODAL CONTAINER

(71) Applicants: Edward G. Scherrer, Mitchell, SD (US); Andrew Robert Scherrer, Mitchell, SD (US)

(72) Inventors: Edward G. Scherrer, Mitchell, SD (US); Andrew Robert Scherrer, Mitchell, SD (US)

(73) Assignee: InSoFast, LLC, Mitchell, SD (US)

( * ) Notice: Subject to any disclaimer, the term of this patent is extended or adjusted under 35 U.S.C. 154(b) by 819 days.

(21) Appl. No.: 17/311,607

(22) PCT Filed: Dec. 6, 2019

(86) PCT No.: PCT/US2019/064860

§ 371 (c)(1),
(2) Date: Jun. 7, 2021

(87) PCT Pub. No.: WO2020/118147

PCT Pub. Date: Jun. 11, 2020

(65) Prior Publication Data

US 2022/0018118 A1 Jan. 20, 2022

Related U.S. Application Data

(60) Provisional application No. 62/776,971, filed on Dec. 7, 2018.

(51) Int. Cl.
*E04B 1/76* (2006.01)
*B65D 88/12* (2006.01)
(Continued)

(52) U.S. Cl.
CPC ..... *E04B 1/7629* (2013.01); *B65D 88/121* (2013.01); *B65D 90/06* (2013.01);
(Continued)

(58) Field of Classification Search
CPC .. B65D 88/121; B65D 2590/02; B65D 90/06; E04B 1/762; E04B 1/7629; E04B 1/3483; E04B 1/7675
See application file for complete search history.

(56) References Cited

U.S. PATENT DOCUMENTS 4,494,348 A * 1/1985 Kastelic ..... E04C 2/405 52/794.1
8,635,824 B2 1/2014 Scherrer
2018/0273291 A1 9/2018 Scherrer et al.

FOREIGN PATENT DOCUMENTS

CH 565 909 A5 8/1975
DE 34 13 324 A1 10/1985
(Continued)

OTHER PUBLICATIONS

International Search Report and Written Opinion of the International Searching Authority for International Patent Application No. PCT/US2019/064860 mailed Mar. 11, 2020, 14 pages.

*Primary Examiner* — Babajide A Demuren
(74) *Attorney, Agent, or Firm* — Merchant & Gould P.C.

(57) ABSTRACT

An intermodal container includes a base, a roof, walls extending between the base and the roof, at least one of the walls having a corrugated surface. An insulation for the intermodal container includes a plurality of insulation units, each of the insulation units having a corrugated surface complementary to the corrugated surface of the intermodal container. Frist one of the insulating units has insulating material having a cross-section with a first face and an opposite second face, the first face including a longitudinally extending planar first central section and first and second longitudinally extending planar slanted sections on opposite sides of the first central section. The first and second slanted sections extend obliquely from the first central section
(Continued)

toward the second face. A segmented support element is embedded in the insulation unit.

10 Claims, 18 Drawing Sheets

(51) Int. Cl.
*B65D 90/06* (2006.01)
*E04B 1/348* (2006.01)

(52) U.S. Cl.
CPC ..... *E04B 1/3483* (2013.01); *E04B 1/7675* (2013.01); *B65D 2590/02* (2013.01)

(56) References Cited

FOREIGN PATENT DOCUMENTS

| | | | | | |
|---|---|---|---|---|---|
| FR | 2 225 588 | A1 | 11/1974 | | |
| WO | WO-2018165568 | A1 * | 9/2018 | ..... | B65D 88/121 |
| WO | WO-2020118155 | A1 * | 6/2020 | ..... | E04B 1/7675 |

* cited by examiner

SYSTEM AND METHOD FOR INSULATING AN INTERMODAL CONTAINER

This application is a National Stage Application of PCT/US2019/064860, filed Dec. 6, 2019, which claims priority to U.S. Provisional patent application Ser. No. 62/776,971, filed Dec. 7, 2018, the entire disclosures of which are incorporated by reference in their entireties. To the extent appropriate, a claim of priority is made to each of the above disclosed applications.

BACKGROUND OF THE INVENTION

Field of the Invention

The present invention is directed to an insulation panel and insulating system, and in particular, to an insulation panel and system configured for use with corrugate walls, such as in intermodal containers.

Description of the Prior Art

Wall systems that require finishing and/or insulation are well known and take on numerous configurations such as masonry, concrete modular units, poured concrete walls, wood frameworks and other common structural systems that generally provide satisfactory installation and support. Often, walls require insulation and may also require finishing over the insulation. Moreover, a vapor barrier should often be established to prevent or minimize mold and moisture damage and resist rusting or other corrosion. Moreover, such systems should avoid high thermal conductivity and resist rusting or other corrosion.

Various types of insulation systems have been developed and are widely used including fiberglass insulation. However, fiberglass insulation is susceptible to water damage and mold if moisture is present. In addition, the thickness required for adequate insulation may decrease the overall size of the interior space due to the added depth of the fiberglass layer. Fiberglass insulation is also difficult to handle and requires special gloves and a respirator. Many types of foam insulation have also been developed and utilized for various applications. However, such foam types of insulation are often open foam so that the material allows moisture to pass through and may retain some moisture. Common stud and foam insulation systems also suffer from difficult installation as may be required for wiring, switches, tubing and other components along with the insulation. Conventional systems typically have a profile that is too thick for many applications.

To overcome such problems, systems have been developed that provide an insulation layer using panels that align and attach with one another and mount to the wall. Such a panel type system is shown in U.S. Pat. No. 8,635,824 entitled INSULATION PANEL SYSTEM and issued to Scherrer. Such systems were sold under the commercial name INSOFAST and have proven to be very successful in providing superior insulation systems provides multiple advantages over prior art systems. The INSOFAST panel systems are widely adapted to many types of applications and able to be used for radon abatement under adsorptive claddings, under exterior insulation finish systems (EIFS), for retrofitting drain and dry insulation for exterior existing structures, for retrofit of drain and dry insulation for interior of existing structures. The system has been used in existing flooring, against foundation walls, above grade concrete or frame construction on either the interior or exterior and can be matched up to existing frame walls for extra insulation. The panels can be used as an insulation board when mounted on the exterior and can be used on top of existing floors or plaster walls, even if damaged, or on ceilings. The system may also be used to add additional insulation to insulated concrete forms and can be used in multiple layers and used in precast applications and can incorporate snap in for chase covers to keep the chase ways open. This system forms a weather resistant barrier that does not require tape or adhesives and has self-sealing attachment points with the embedded studs making installation simple and reliable.

Although the INSOFAST system of U.S. Pat. No. 8,635,824 has been successful for a wide range of uses, particular applications require a different approach. It can be appreciated that large shipping containers, also referred to as intermodal containers, may have cargos or applications that require insulation. Moreover, such intermodal containers have become popular for use as tiny homes. Their strength and standard sizes of intermodal containers also make them suitable for modular construction with multiple intermodal containers joined to form a larger structure. Use of the intermodal containers for building construction also typically requires insulation. Standard intermodal containers are typically made of steel and have a corrugated type wall structure. Such corrugated walls provide alternating spaced apart recesses and protrusions that reduce the effectiveness of planar insulation systems due to the gaps. Moreover, the corrugated type walls of intermodal containers provide for more difficult installation due to the spaced apart recesses of the corrugations. To address such installation challenges, planar systems such as the INSOFAST insulation system have been supplemented with strips of insulation material cut and trimmed to fill in the spaces formed by the corrugated wall and therefore eliminate the gaps. Although this approach provides satisfactory insulation performance, installation can be challenging and labor intensive as strips must be cut and installed along with the planar panels to eliminate the gaps.

Support elements that attach to metal surfaces such as in intermodal containers may have different expansion/contraction rates. Therefore, when attached elements are heated or cooled, there may be different amounts of expansion or contraction. These differences may lead to warping and/or failure for long continuous support elements.

It can be appreciated that a new and improved system is needed that provides for superior insulation of corrugated walls such as in intermodal containers. Such a system should fill the gaps formed by a corrugated wall structure. Moreover, such a system should provide for obtaining a planar outer exposed surface for easy mounting of additional layers and/or finishing. Such a system should also create water, thermal and vapor control layers or barriers and should provide for easily forming chases and channels for wiring, plumbing and other structures. Such a system should be easy to install and provide alignment between adjacent panels laterally and vertically. Moreover, although extended panels having a corrugated face may address many of the problems associated with insulating a corrugated wall, different insulating elements configured for placement against a corrugated wall may be needed. Individual insulation elements filling the recesses of a corrugated wall would provide for complementing conventional insulation systems to achieve an insulation installation with superior R-factor and moisture properties with a thinner profile. Such individual insulation elements should provide for being mounted by adhesive and may incorporate a mounting element to receive mounting hardware from other insulation and/or finishing layers. Such mounting elements should be configured to resist warping and failure when mounted to surfaces having a different expansion and contraction coefficient. The present invention addresses these as well as other problems associated with insulation of corrugated walls.

SUMMARY OF THE INVENTION

The present invention is directed to insulation units and an insulation system for large shipping containers, also known as intermodal containers. Intermodal containers have a rectangular box-like configuration. Such containers typically have a door at one end and are configured for placement in close proximity to adjacent containers and may be stacked. Such containers typically have walls that have corrugated cross sections with alternating protruding portions and recesses.

According to the present invention, insulation elements are configured to closely mount against the corrugated walls without gaps. The system provides for various different insulating elements that may be utilized on the inside, outside or both faces of corrugated walls. Moreover, the insulation elements provide additional insulation and for mounting of other finishes or layers over the insulation layer.

A first embodiment of an insulation unit includes a foam type insulation element having a cross section with parallel opposite front and rear faces. Sides of the insulation element have faces that converge to provide a truncated pyramid cross section. Such elements have a taper on the sides that matches the recesses formed in the corrugated wall of the intermodal container.

In a first embodiment, the insulation units include an embedded stud type mounting element. The embedded stud provides additional support to the insulation unit and extends longitudinally within the unit. Moreover, the stud extends to a first face and includes ridges for mounting fasteners or applying adhesive for securely attaching and mounting the insulation unit to the corrugated wall of the intermodal container. The stud also extends to the opposite face and provides a mounting surface for fasteners and/or adhesive to mount further layers over the insulation unit. The stud has a substantially H-shaped cross section with center connecting ribs that allow the foam of the insulation unit to extend through and provide an interlocking relationship between the foam and the stud. Moreover, the first portion includes a substantially continuous portion while the connecting ribs and second portion are formed as segments to provide some flexibility of the stud. Such a configuration prevents failure due to expansion or contraction due to different expansion/contraction rates for different materials.

The first insulating element also includes complementary tongues and for assembling the insulation units in a stacked configuration and to provide alignment. Moreover, shoulder portions are formed into the outer surface to provide an internal corner for receiving conventional planar insulating elements. In this manner, the insulating layer may be continuous and all portions of the recesses and protruding portions of an intermodal corrugated wall receive an insulating layer. Further planar elements or other insulation layers may also be placed over the insulation units and planar portions.

A second type of insulation unit is a foam element that is configured to nest into the recesses. The second insulation unit includes an insulating insert element that includes parallel front and rear faces with converging side faces that are configured to fit closely against the recesses of the corrugating wall of an intermodal container. The second insulation units may be configured with vertical raceways for application of adhesive and/or draining and ventilation. Such insulation units are used with the first insulation units and do not require an internal support as the mounting of other layers can be made to the first insulation units.

A third insulation unit is a planar unit that includes a first face having a corrugated configuration complementary to the corrugated wall of the intermodal unit. The first face includes alternating protruding portions and recesses with angled faces extending between them. With this configuration, the insulating panel may be placed snugly against the intermodal wall without gaps. The panel may also include internal support elements that are the same or similar to the studs of the first insulation unit. Such a panel may also include alignment elements along the edges of the top, bottom and sides. Moreover, markings may be added as appropriate to assist with routing wiring and other lines.

The present invention provides for using the first, second and third insulation units as may be necessary and they may be mixed and matched for achieving the particular requirements for insulating an intermodal container. Moreover, additional insulation layers of various types and configurations may be mounted over the insulation units of the present invention to achieve greater insulating characteristics.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals and letters indicate corresponding structure throughout the several views.

DETAILED DESCRIPTION OF THE PREFERRED EMBODIMENT

Figure 1:
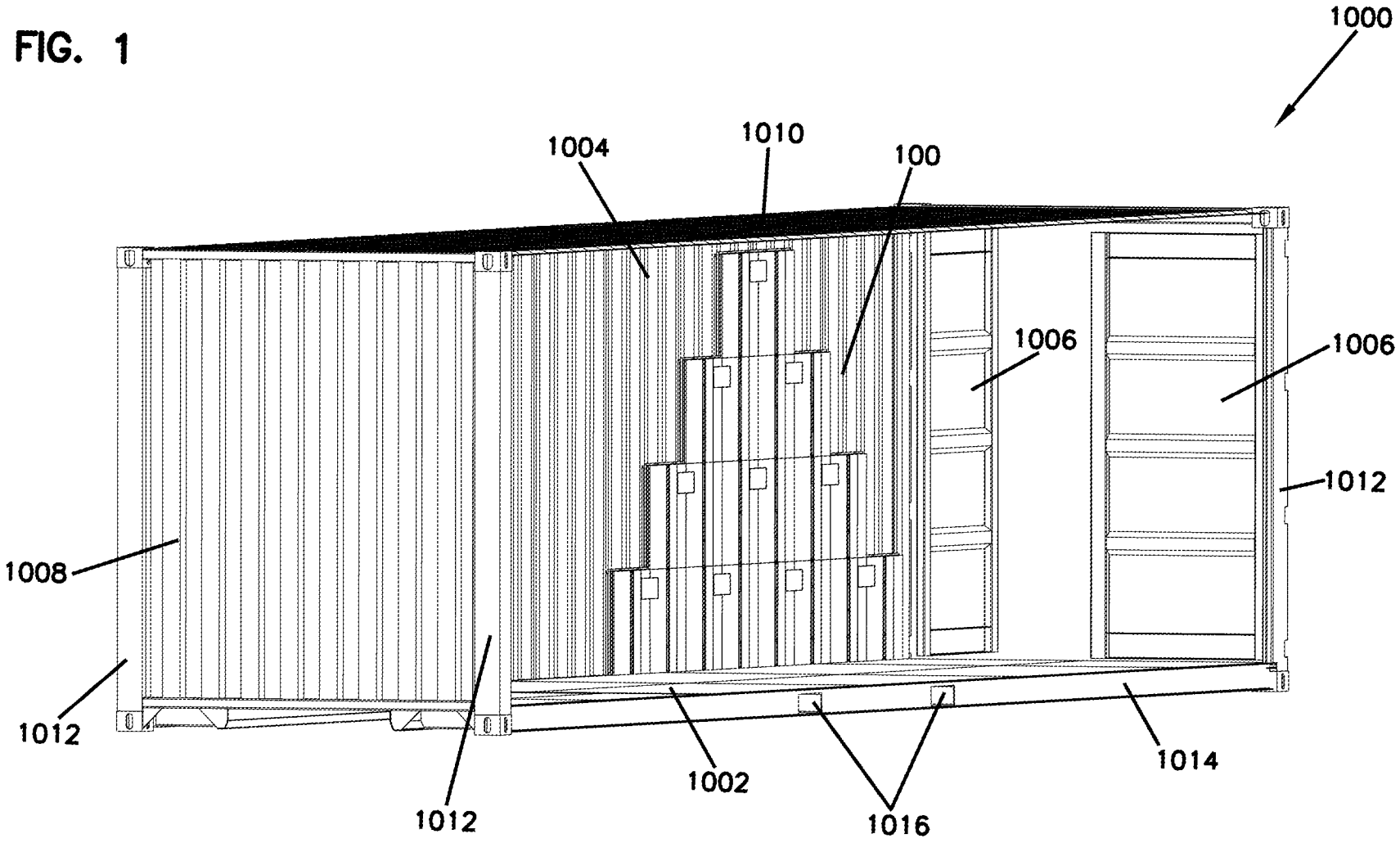
FIG. 1 is a perspective view of an intermodal container with portions removed for clarity and a portion of the wall covered with an insulation system according to the principles of the present invention.
Figure 2:
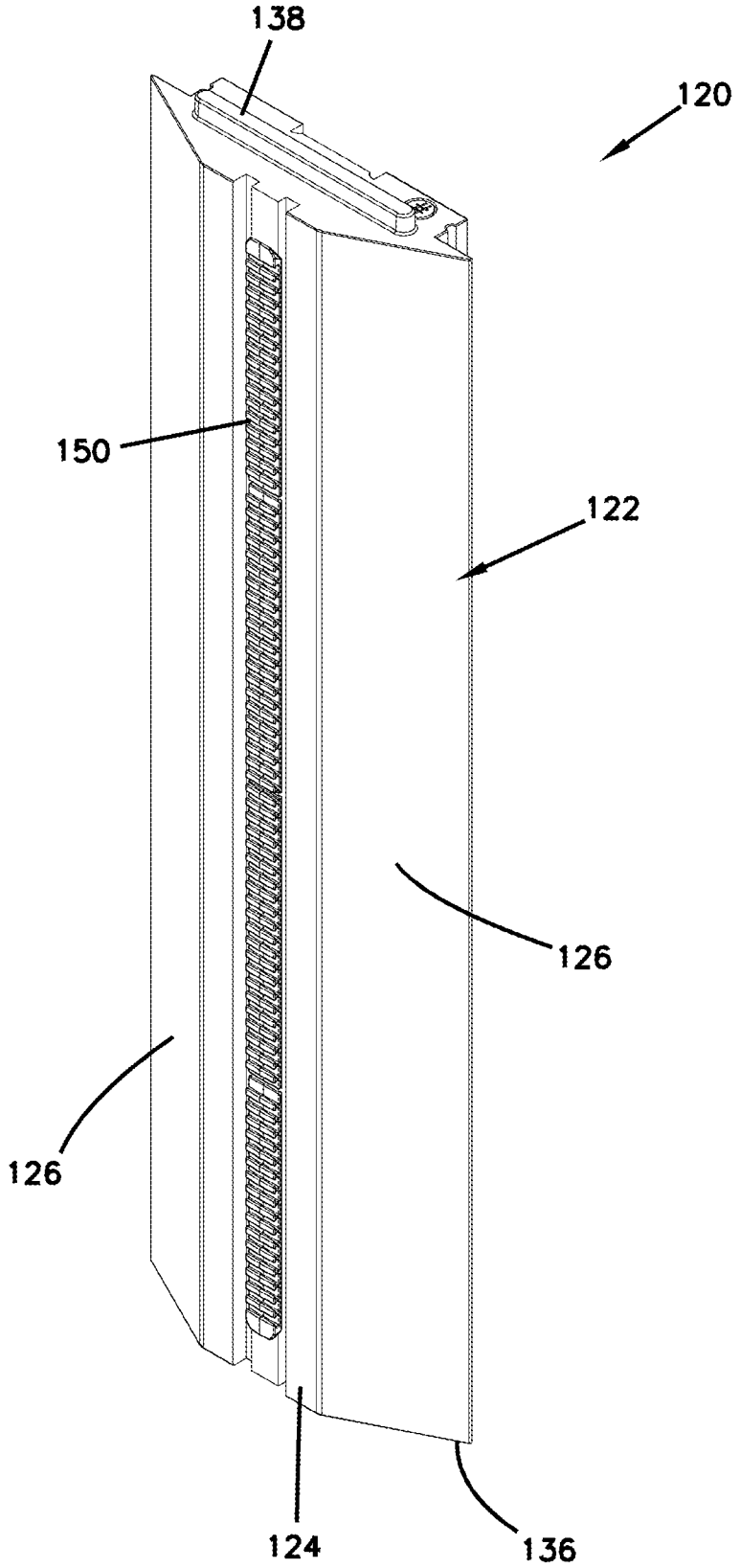
FIG. 2 is a perspective view of an insulation unit for installation in an intermodal container according to the principles of the present invention.
Figure 3:
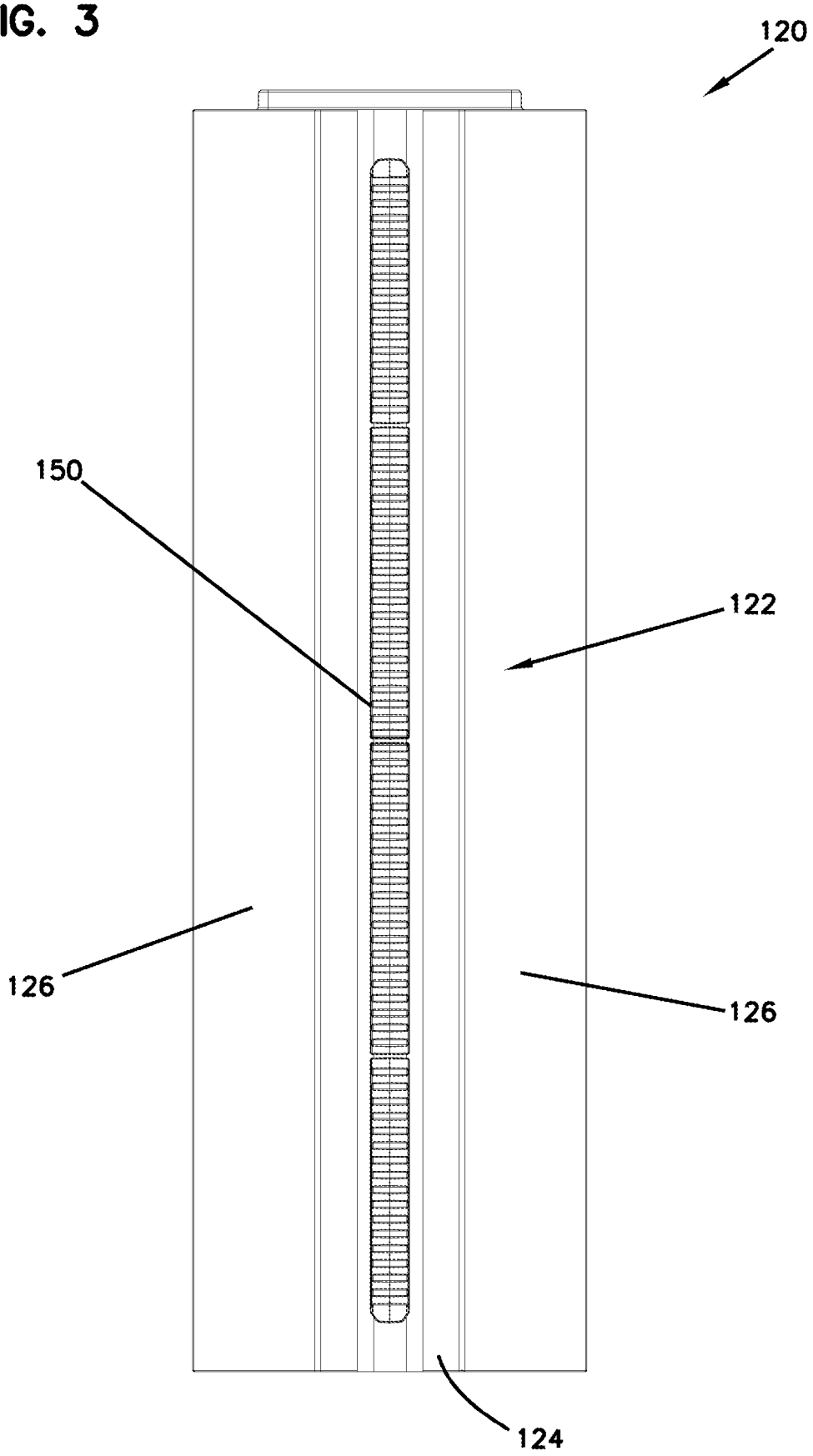
FIG. 3 is a front elevational view of the insulation unit shown in FIG. 2.
Figure 4:
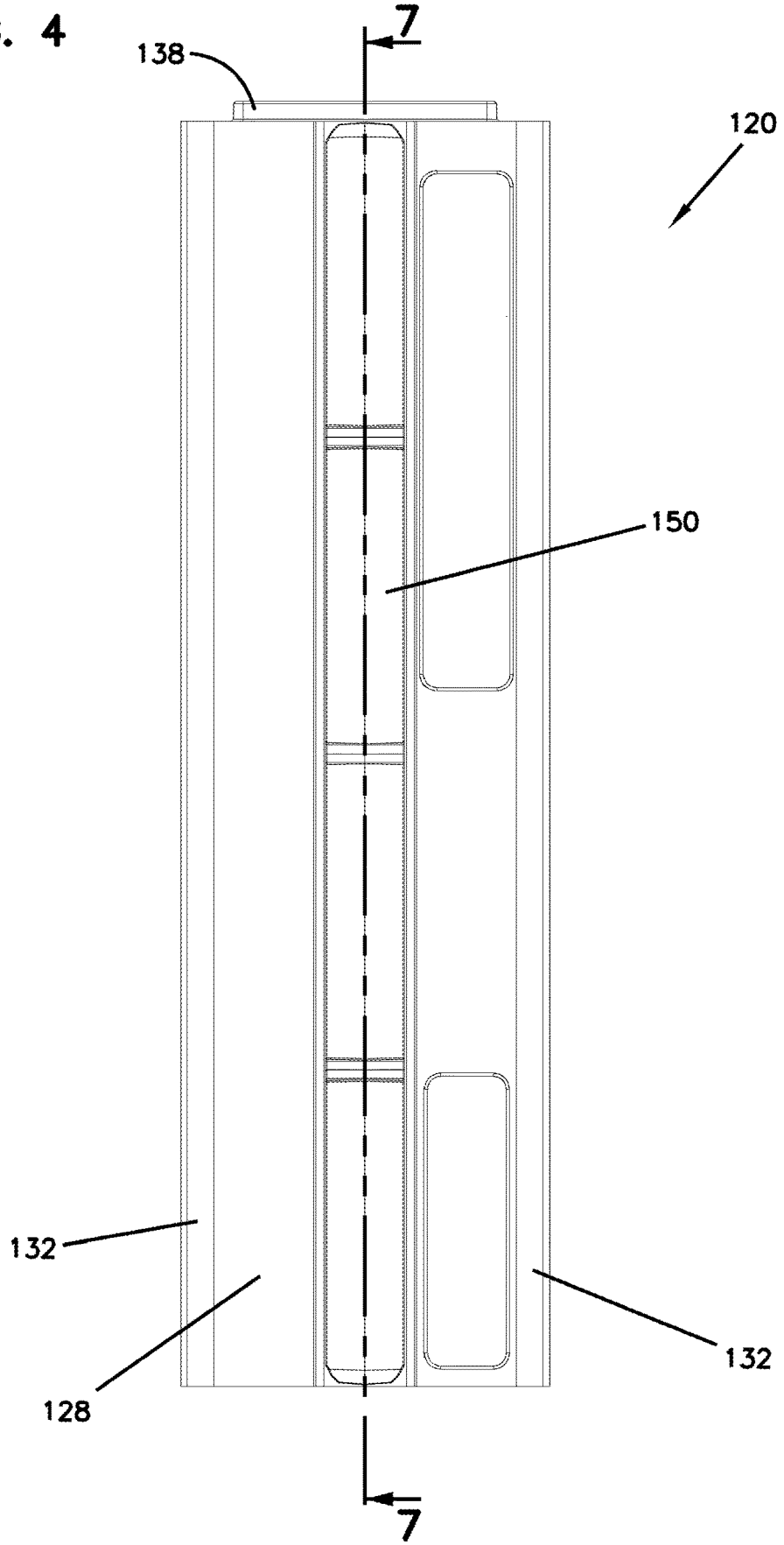
FIG. 4 is a rear elevational view of the insulation unit shown in FIG. 2.
Figure 5:
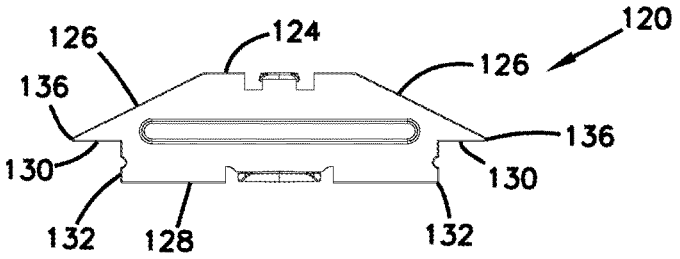
FIG. 5 is an end view of the insulation unit shown in FIG. 2.
Figure 6:
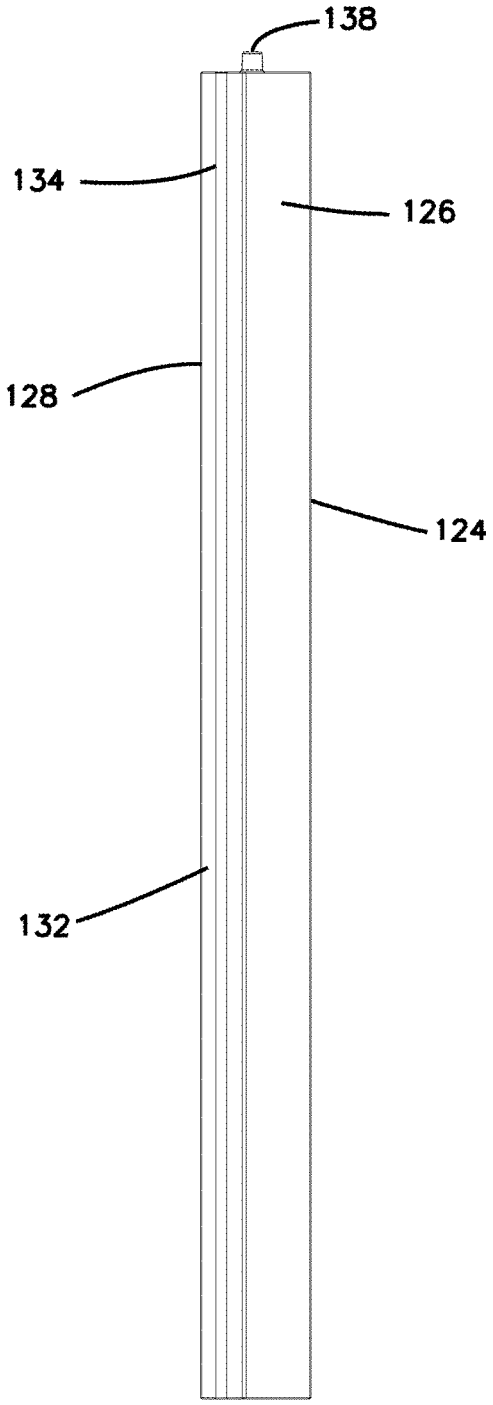
FIG. 6 is a side view of the insulation unit shown in FIG. 2.

Intermodal containers, commonly referred to as shipping containers are generally rectangular. Referring now to FIG. 1, a typical intermodal container (1000) has a floor (1002), sidewalls (1004), doors (1006), an end wall (1008) and a roof (1010). A standard container is typically 40 feet or 20 feet long, 8 feet 6 inches high and 8 feet wide. Intermodal containers are generally made of metal (steel) with at least the sidewalls (1004) and the end wall (1008) configured with a corrugated cross-section to increase the strength of the walls. The corrugations typically have a depth of 1.25 inches up to 2 inches. Corner posts (1012) provide added support for the container (1000) and sufficient support for lifting the container. Bottom frame members (1014) include openings (1016) for forklift tines or straps to lift the container (1000). The standardized containers (1000) are modular for closely fitting against adjacent containers (1000) and may also be stacked for storage and during transportation.

An insulating system (100) is formed of insulation units, inserts and interconnected panels, described hereinafter, that mount to the walls (1004) with glue or conventional fasteners. A finishing layer, such as paneling, drywall, siding or other finishing treatments mounts with fasteners, glue or other conventional mounting techniques to the insulation layers, insulation units, inserts and/or insulating panels. As explained hereinafter, the insulating system (100) includes insulation units having embedded studs that provide for mounting of other elements. For some applications, a coating such as paint, wallpaper or other final, exposed material that is visible may cover certain finishing layers, such as drywall. The system of the present invention provides for elimination of the conventional stud framing and roll-type insulation being installed in an intermodal container (1000) and provides improved R-value in a thinner layer, adding floor space and volume to the finished interior of an intermodal container. The insulating system (100) may also be added to the exterior of the intermodal container with or without additional insulation. The insulating system (100) may therefore be mounted to the inside, to the outside or to the inside and the outside of an intermodal container (1000). When mounted to an exterior of an intermodal container (1000), the insulating system (100) may create a rain screen cavity that promotes quick drying of any moisture within the walls. Moreover, the insulating system (100) isolates fasteners of exterior cladding and eliminates thermal bridging. The present invention is less expensive and easier to install than prior conventional building systems and techniques.

Referring now to FIGS. 1-7, the insulation system may include insert type first insulation units (120) that provide for mounting against the corrugated faces of walls of an intermodal container. Each of the insulation units (120) has a profile that is complementary to the corrugated face of the intermodal container and configured to nest against a corrugated wall in a form-fitting manner. The first insulation units (120) also provide support so that fasteners may be attached to the insulation unit and other layers applied over the insulation units (120). Each insulation unit (120) includes a molded foam portion (122). Embedded within the foam portion (122) is a mounting stud (150). The stud (150) is generally a lightweight element extending longitudinally along the length of the insulation unit (120) and provides added support. The insulation unit (120) forms a center protruding face (124) with angled faces (126) on either side. The protruding face (124) and angled faces (126) are made to be complementary to the surface of the corrugated wall of an intermodal container (1000), such as shown in FIG. 1. A first portion of the mounting stud (150) extends through to the protruding face (124) of the insulation unit (120). The opposite exposed face (128) is generally planar and has an opposite portion of the mounting stud (150) extend there through. On either side of the planar opposite face (128) are shoulder surfaces (130) and (132) that provide for receiving a corner of planar insulation panels, as explained hereinafter. A slot (134) is formed in the surface (132) and provides for applying adhesive or to form a channel to provide venting and/or drainage. The intersection of the angled faces (126) with the outer edge of the shoulder surface (130) forms a rounded edge (136). The rounded edge (136) also provides for forming a small channel when installed that may be used for adhesive and/or drainage or venting. The top of the insulation unit (120) includes a protruding tongue (138) and the bottom of the insulation unit (120) has a complementary groove (140) for receiving the tongue (138) so that the insulation units (120) may be stacked one upon another vertically and maintained in alignment. In one embodiment, the insulation units (120) are made of a closed cell expanded polystyrene material. Such a material is lightweight, provides excellent insulation performance and is impervious to water. Moreover, such material may include a fire retarder.

Referring now to FIGS. 8-12, the stud element (150) is a lightweight molded element that provides internal support for the insulation units (120). The stud (150) is an elongate element that extends generally along the longitudinal axis of the insulation unit. The stud element (150) has a somewhat "H" shaped cross section with a first planar portion (152) and a second planar portion (158) joined by a center connecting portion (154). The center connecting portion (154) includes connecting ribs (156) that provide openings through which insulation extends to provide greater interaction for the stud. The first portion (152) includes channels (164) extending laterally transverse to the longitudinal axis. The second portion (158) includes ridges (160) extending transverse to the longitudinal axis of the mounting stud (150). The ridges (160) may extend through the second face of the insulation unit and provide for mounting or application of adhesive. It can be appreciated that the stud (150) eliminates a thermal connection through the insulation unit (120) and provides for receiving screws, nails or other fasteners, as well as for having adhesive mount to the exposed ridges (160) of the second portion (158) for secure mounting while eliminating a thermal path extending from front to rear through the thermally conductive path through the insulation unit. The first portion generally extends the length of the stud while the second portion and connecting portion (154) are divided into segments (162). The segments (162) allow for the stud element (150) and therefore the insulation unit (120) to have some degree of flexure should the application not be entirely planar and provides for adapting to expansion and/or contraction of the insulation units.

Figure 7:
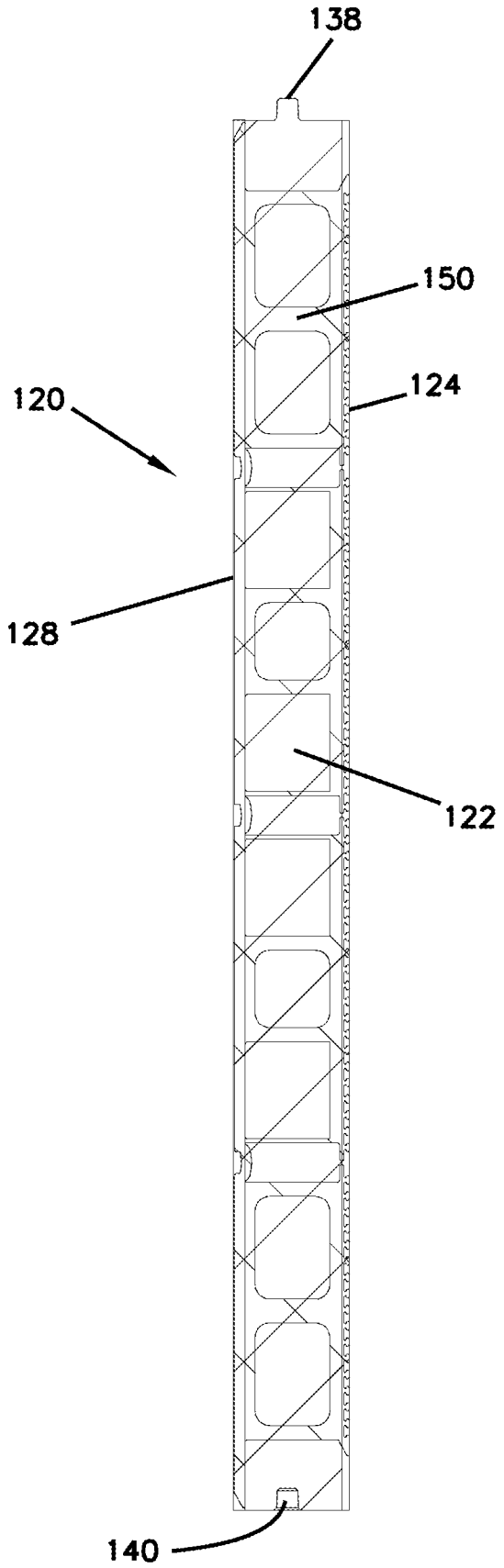
FIG. 7 is a sectional view thereof taken along line 7-7 of FIG. 4.
Figure 8:
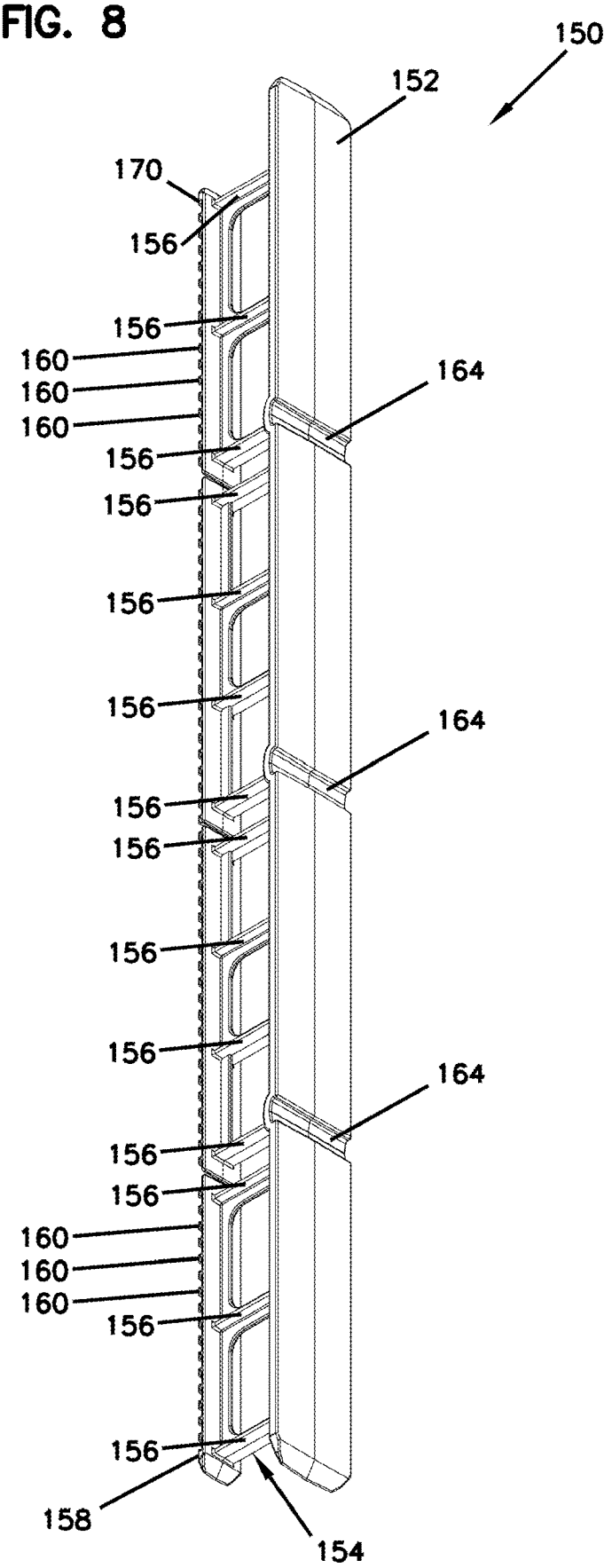
FIG. 8 is a perspective view of a stud element embedded in the insulation unit shown in FIG. 2.
Figure 9:
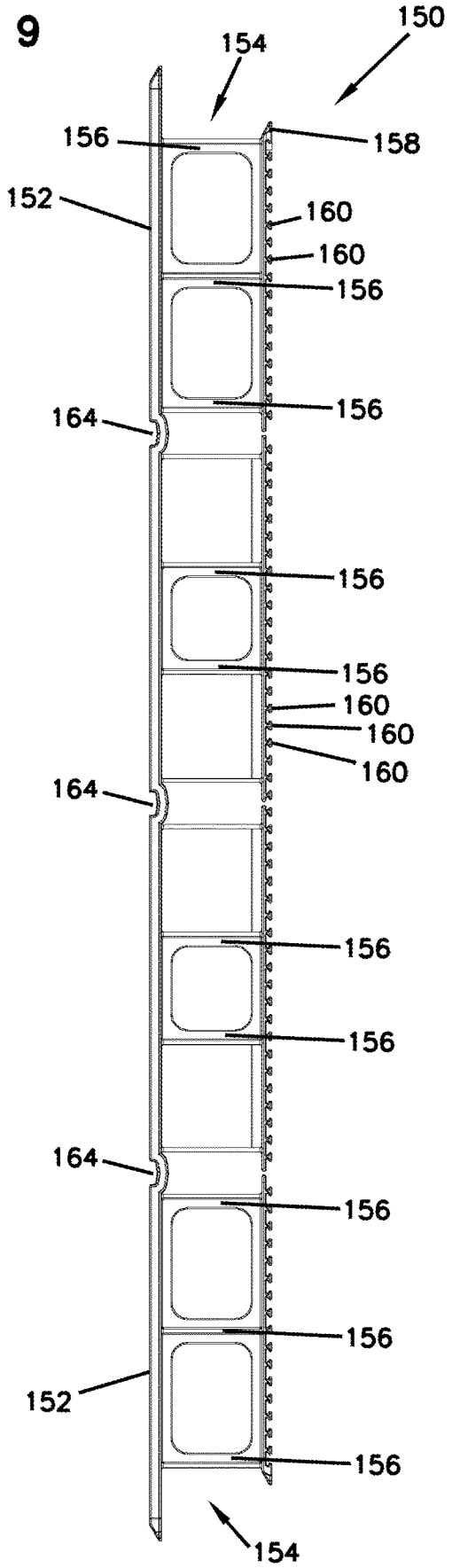
FIG. 9 is a side elevational view of the stud element shown in FIG. 8.
Figure 10:
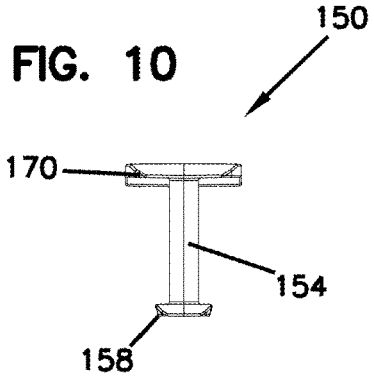
FIG. 10 is an end view of the stud element shown in FIG. 8.
Figure 11:
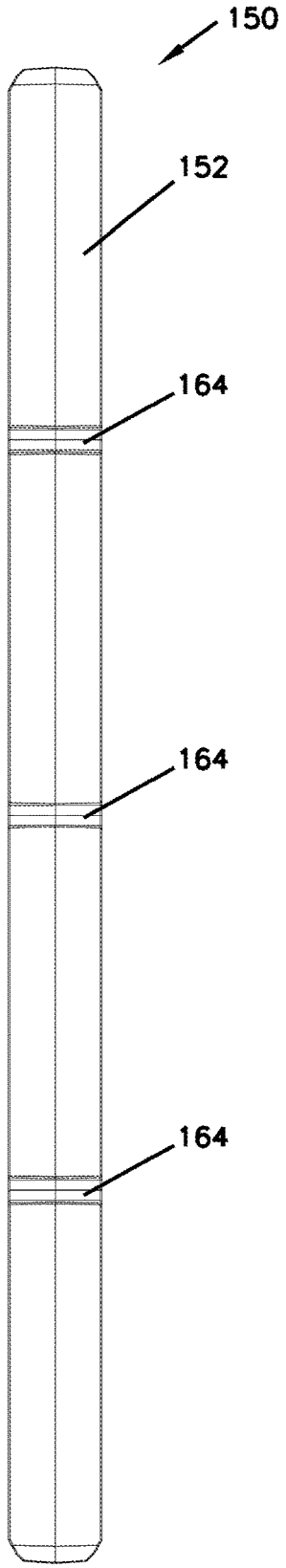
FIG. 11 is a top plan view of the stud element shown in FIG. 8.
Figure 12:
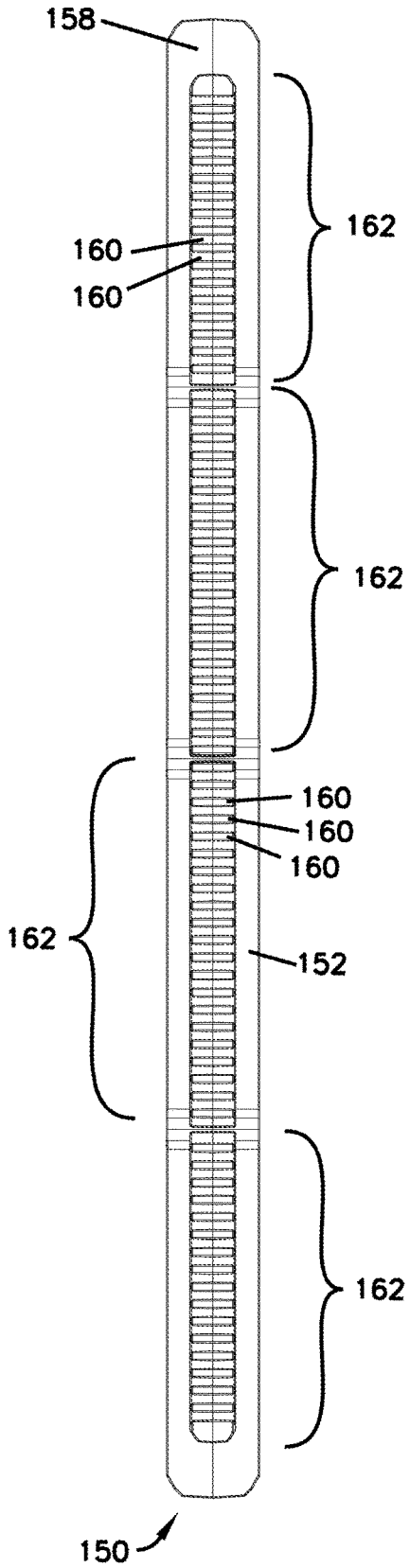
FIG. 12 is a bottom plan view of the stud element shown in FIG. 8.

Referring again to FIGS. 2, 3 and 7, the mounting stud (150) extends through to both faces (124) and (128) of the insulation unit (120). It can be appreciated that at the protruding face (124), the ridges (160) extend through the foam portion (122) and provide for mounting of fasteners and/or application of adhesive. Moreover, the first portion (152) extends through the face (128) with transverse channels (164) exposed. The exposed mounting stud (150) provides for a visual indicator for centering the insulation unit (120) and for mounting fasteners and other elements to the insulation unit (120). As shown in FIG. 7, the foam portion (120) extends through the open portions of the mounting stud (150) and provides an interlocking connection of the embedded mounting stud (150) with the foam (122).

Figure 13:
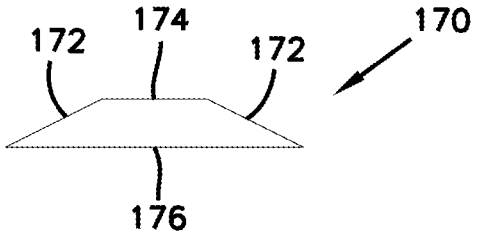
FIG. 13 is an end view of a first embodiment of a foam insulation insert used in conjunction with the insulation unit shown in FIG. 2.
Figure 14:
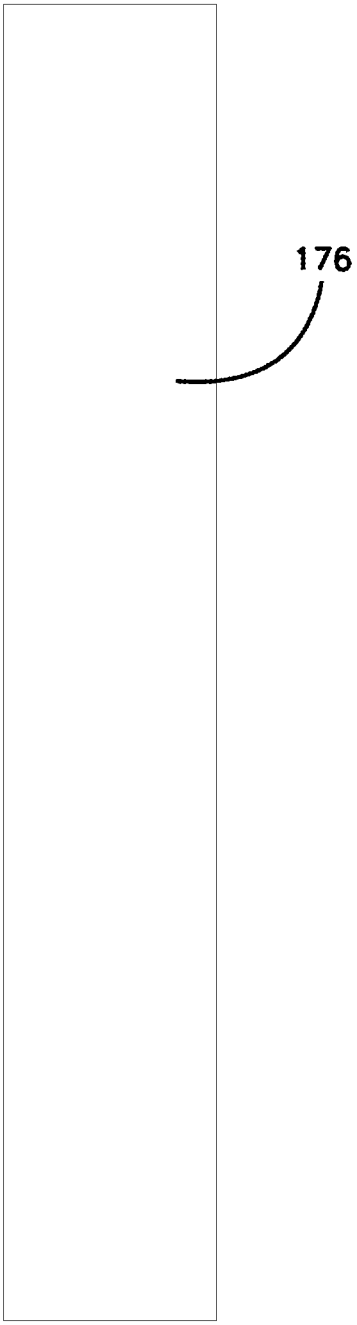
FIG. 14 is a front end view of the insert shown in FIG. 13.

Referring now to FIGS. 13 and 14, an insulation insert (170) has an outer periphery somewhat similar to the insulation unit (120). The insert (170) has faces (172) that generally correspond to the angled faces (126) of the insulation unit (120) and a face (174) generally corresponding to the protruding face (124). The insulation inserts (170) may be used in conjunction with the insulation units (120) to provide a planar surface for mounting conventional planar insulation panels. As mounting of additional insulation and other layers may be to the insulation units (120), the insulation inserts (170) have no need for mounting and therefore do not incorporate an imbedded mounting stud. The insulation inserts (170) may be adhered or glued in place to keep them more secure. When the insulation units (120) and the insulation inserts (170) are used together against a corrugated wall, some of the recesses of the corrugated wall will received the insulation units (120) while other recesses of the corrugated wall receive the insulation inserts (170). In one embodiment, the insulation inserts (170) are made of a closed cell expanded polystyrene material. Such a material is lightweight, provides excellent insulation performance and is impervious to water. Moreover, such material may include a fire retarder.

It will also be appreciate that where greater support for mounting is required, some or all of the insulation inserts (170) may be eliminated. Where a high level of insulation is needed, it is generally preferred to have every recess in the corrugated wall filled. Therefore, in some configuration the system may use a more or fewer insulation units (120) or may only use the insulation inserts (120). However, for some applications, the walls may require little or no insulating. For such applications, some of the recess of a corrugated wall may be left empty to provide a vertical ventilation space.

Figure 15:
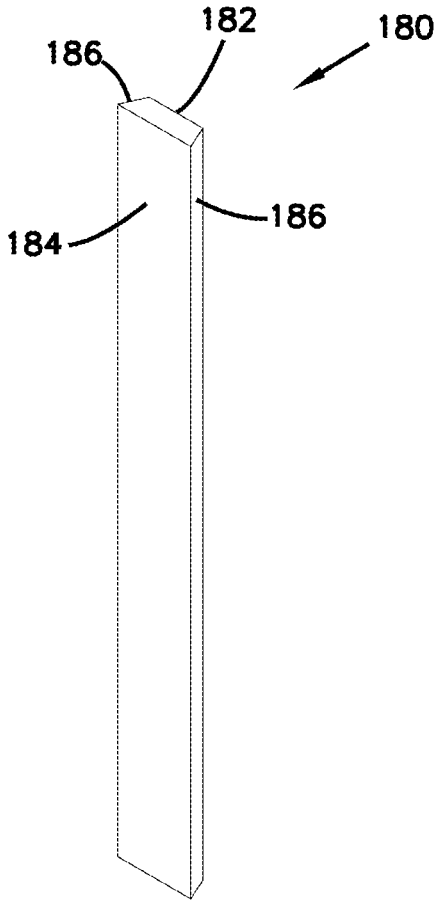
FIG. 15 is a perspective view of a second embodiment of a foam insulation insert.
Figure 16:
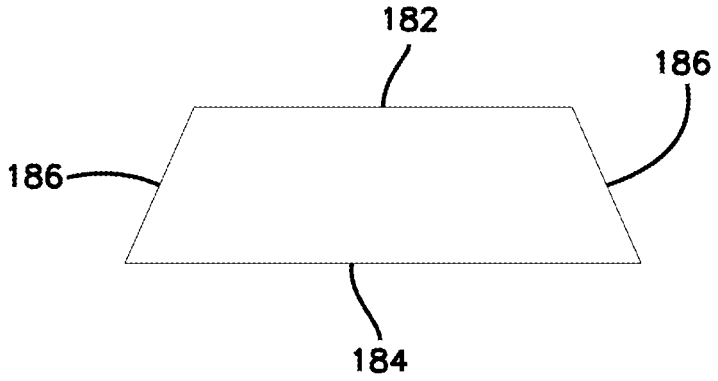
FIG. 16 is an end view of the insert shown in FIG. 15.

Referring now to FIGS. 15 and 16, there is shown a further embodiment of an insert, generally designated (180). The insert (180) also has a truncated pyramid shaped cross section with a pair of parallel opposite faces (182) and (184). The opposite faces (182) and (184) are connected at their sides by angled faces (186). The inserts (170) of FIGS. 13 and 14 and (180) of FIGS. 15 and 16 are similar except for the relative dimensions and are configured for insulating different walls having different corrugated shapes forming the intermodal containers. It can be appreciated however that further shapes are also possible that are configured to be complementary and fit closely against a wall of an intermodal container.

Figure 17:
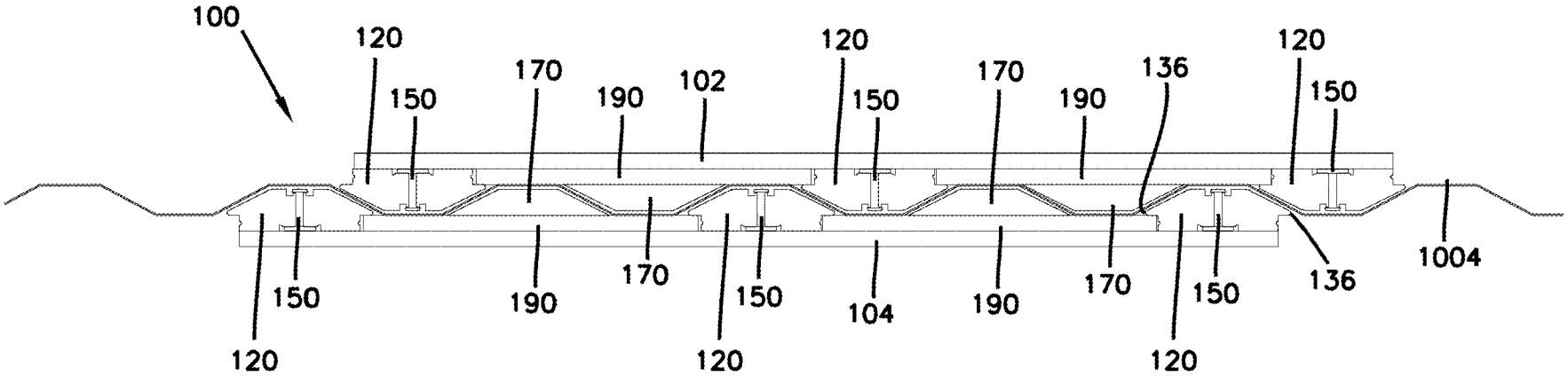
FIG. 17 is a top sectional view of the insulation units and insulation inserts installed against a corrugated wall of an intermodal container and having planar insulation components.
Figure 18:
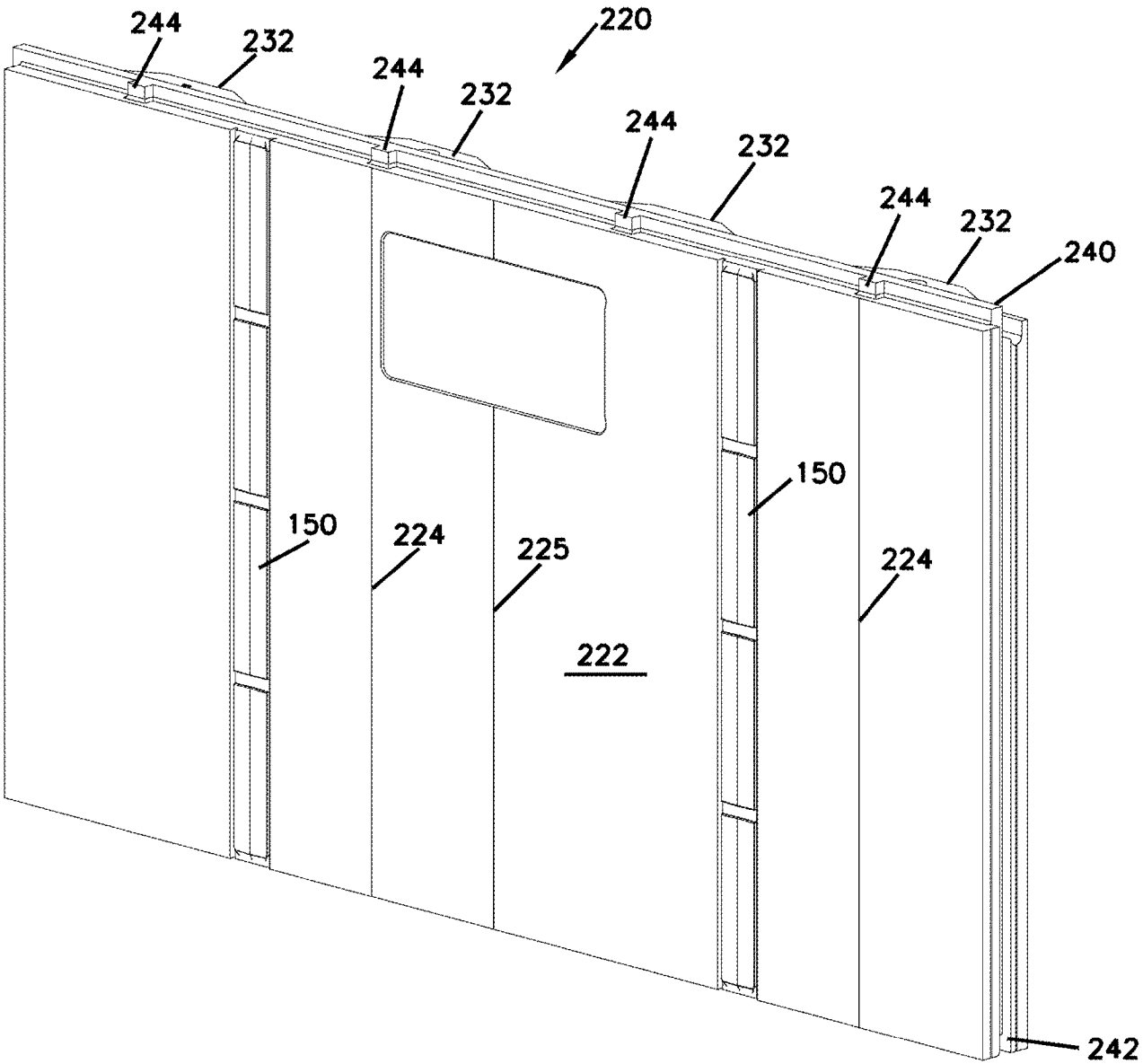
FIG. 18 is a front perspective view of an insulation panel according to the principles of the present invention for installation in an intermodal container.
Figure 19:
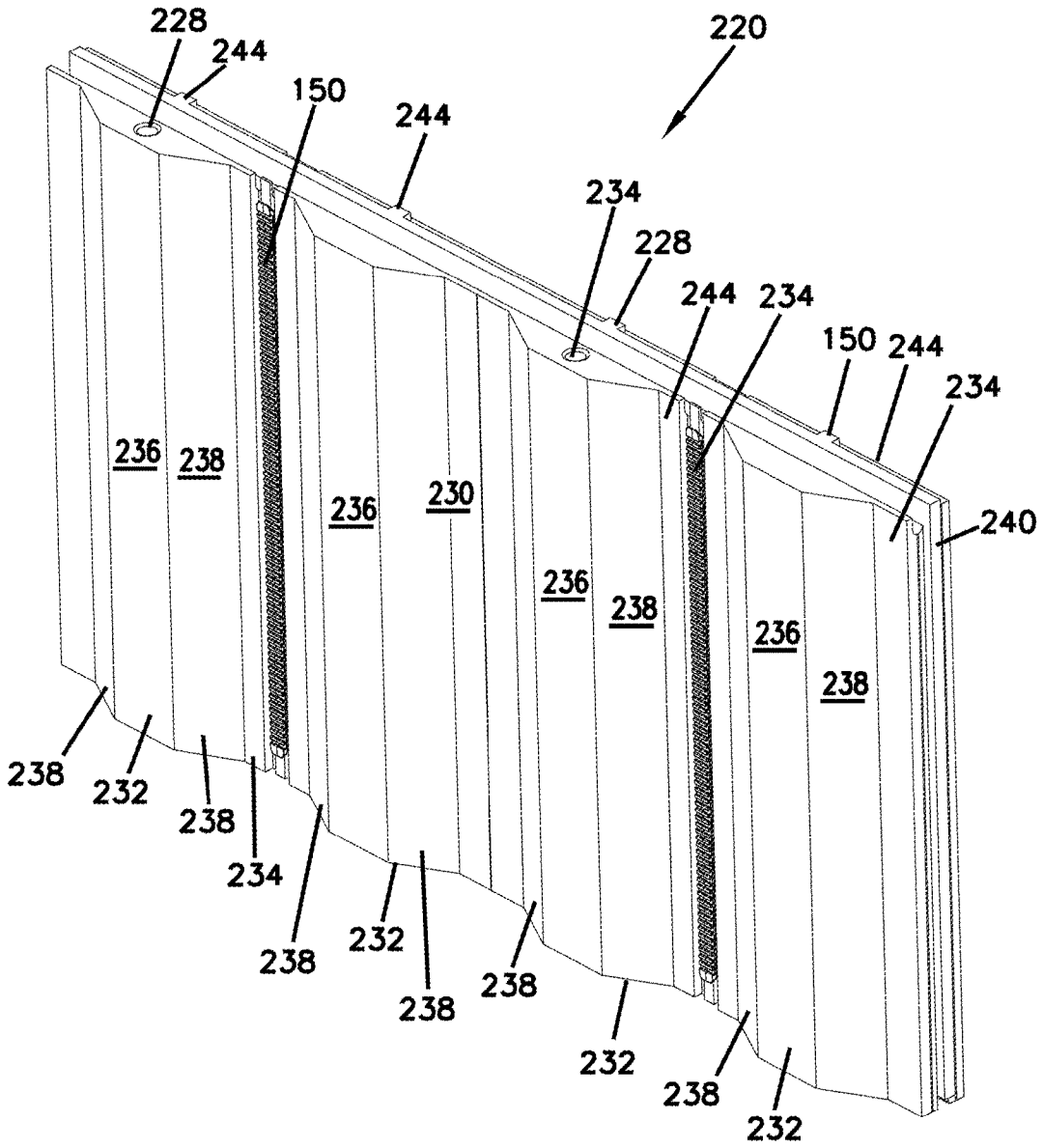
FIG. 19 is a rear perspective view of the insulation panel shown in FIG. 19.
Figure 20:
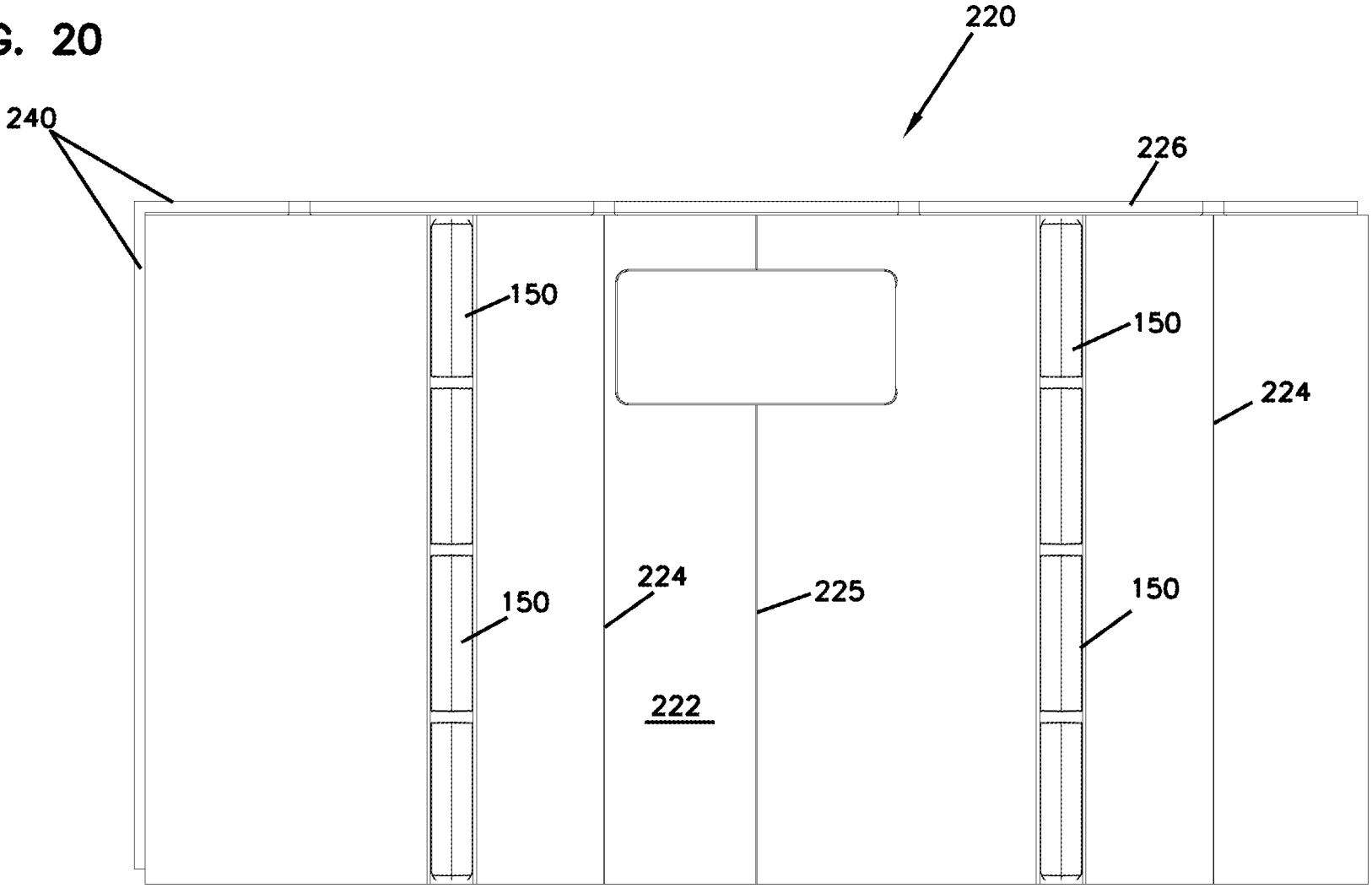
FIG. 20 is a front elevational view of the insulation panel shown in FIG. 19.
Figure 21:
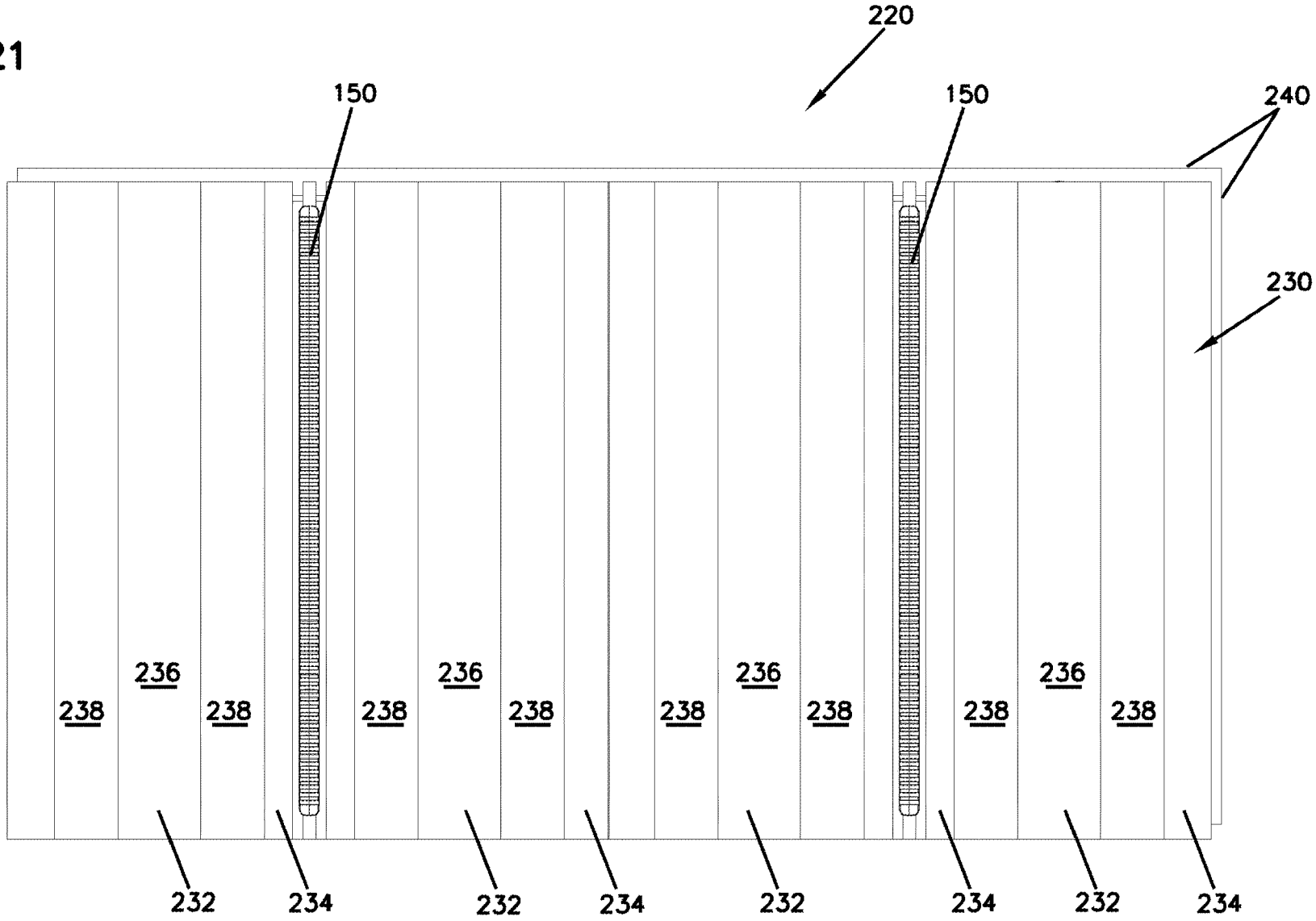
FIG. 21 is a rear elevational view of the insulation panel shown in FIG. 19.
Figure 22:
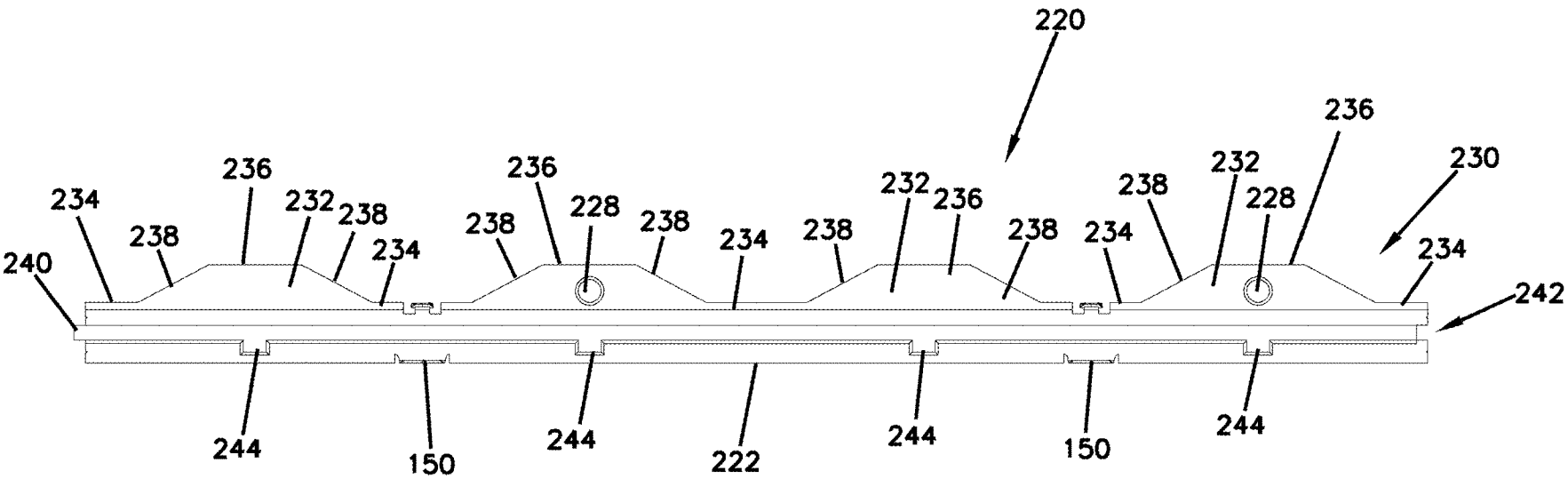
FIG. 22 is a top plan view of the insulation panel shown in FIG. 19.
Figure 23:
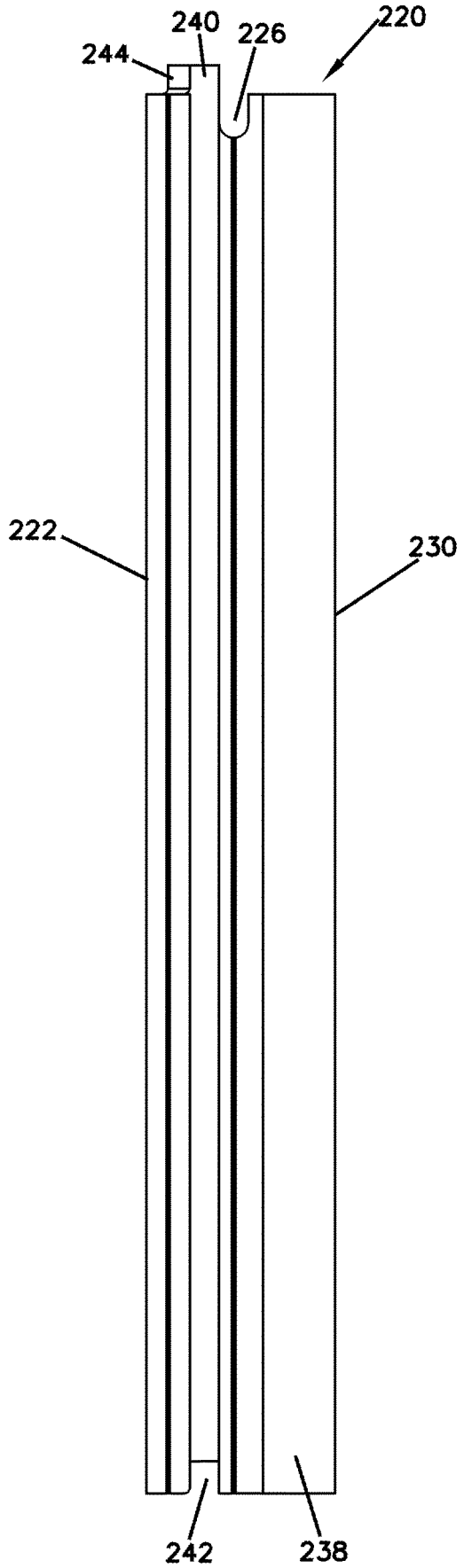
FIG. 23 is a side elevational view of the insulation panel shown in FIG. 19.

Referring now to FIG. 17, there is shown the insulation of a wall system (100) mounted to a wall (1004) of an intermodal container. The insulation system (100) includes an inner finishing layer (102) and outer finishing layer (104). Mounted against the corrugated faces of the wall (1004) are insulation units (120) and insulating inserts (170). Moreover, conventional insulating panels (190) are mounted over the insulation inserts (170) and against the shoulder surfaces (130) and (132) of the insulation units (120). With this arrangement, a continuous insulation layer is obtained by the insulation units (120), inserts (170) and insulation panels (190). The shoulder surfaces (130) and (132) provide added support and strength for the insulation panels (190). When the insulation panels (190) and the finishing layer (104) are fastened to the insulation units, the system (100) expands and contracts as a unit. Moreover, it will be appreciated that although the insulation system is shown with insulation against both faces of the wall (1004) in FIG. 17, such a system may also include insulation on only the inner face or on only the outer face of the wall (1004). Moreover, it can be appreciated that similar systems may be used against the roof and other surfaces of an intermodal container (1000) or other surfaces that have such a corrugated finish.

The insulating system (100) may also incorporate interconnected rectangular insulating panels (220) mounted in an edge-to-edge relationship. As shown in FIGS. 19-23, the panels (220) are generally rectangular and include tongues (240) and complementary grooves (242), such as shown most clearly in FIGS. 20 and 22, along the top and bottom surface and the ends of the panel (220). The tongues (240) and grooves (242) provide for alignment and connection along both the horizontal and vertical edges so that the panels (220) may be connected to extend horizontally and vertically in a continuous insulating layer. The panels (220) also include alignment tabs (244) and complementary notches (246) along the top and bottom edges that aid in aligning the panels (220) for final orientation and alignment. In one embodiment, the panels (220) are made of a closed cell expanded polystyrene material. Such a material is lightweight, provides excellent insulation performance and is impervious to water. Moreover, such material may include a fire retarder. Although a vapor barrier may also be added to the system, it can be appreciated that with the insulating layer (100) made of a water impervious material and with interlocking edges, the need for a separate vapor barrier used in many applications may be eliminated.

Each of the panels (220) includes a generally planar outer face (222) having a series of parallel passages (228) that may serve as wiring chases or for running tubing, fiber optics or other elements through the insulating layer without requiring cutting into the panels (220). Indicator lines (224) are aligned with the passages (228) and a centerline (225) acts as a cutting line for cutting the panels (220) into even halves. The passages (228) also allow water to drain. When the panels (220) are attached, horizontally extending channels (226) are formed. The horizontal channels (226) bypass the vertical passages (2280 so that utilities may be run in both directions without intersecting. The vertical passages (228) provide for easy insertion and routing of wiring, tubing and other elements into the foam material that are typically placed inside walls. In some embodiments, the small section of panel foam between the horizontal channel (226) and the vertical passage (228) may be removed so the channels (226) and the passages (228) connect. Further raceways may also be formed in the panels (220) as is needed. A cutting guide may provide for trimming the panels (220) to a common size and provides a guide for forming a straight edge. It can be appreciated that in one embodiment, the panels are approximately 44 inches wide and 24 inches high (122×61 cm). A typical depth for a panel (220) is two inches (5 cm) at the narrower section and about 3.25 inches at the deepest depth of a corrugation. Such a size provides for standard alignment and easily transporting the panels (220) down narrow staircases such as often lead to a basement. Moreover, smaller panels are easier to fit around openings that large sheets that cover multiple openings.

The panels 220 also include mounting elements (150) that serve as studs embedded into the panels. In one embodiment, each panel (220) includes two embedded mounting studs (150). The mounting studs (150) extend vertically when the panels (220) are installed. The mounting studs (150) may be placed at conventional spacing such as at 16 inch (41 cm) centers or varying on center spacing such as approximately 22 inch centers as is typical with wood stud construction. The mounting studs (150) extend to a first face of the panels (220) and provide a surface for gluing as well as receiving conventional fasteners such as bolts, screws and/or nails. The mounting studs (150) are lightweight, but provide rigidity and strength to the panels (220).

To mount to corrugated walls, such as sidewalls (1004) of an intermodal container, an inner mounting face (230) of each panel (220 has a corrugated surface that is complementary to the corrugated surface of the sidewalls (1004). The corrugated mounting surface (230) includes protruding portions (232) alternating with recesses (234). The protruding portions (232) include a planar face (236) and tapering connection surfaces (238) that lead from the protruding planar face (236) to the planar face of the inner recess (234) and are oblique to the faces (234) and (236). The inner recessed surface (234) and the planar faces (236) of the protruding portions (232) are generally parallel to one another and to the exposed surface on the opposite side of each panel (220). The protruding portions (232), the recesses (234) and the connection surfaces extend generally vertically to align with the complementary portions of the corrugated walls of the intermodal container (1000). The configuration of the panels (220) provides a close fit against the corrugated walls (1004) without gaps.

It can be appreciated that intermodal containers (1000) may be insulated with an insulation layer (100) having combination of the insulation panels (220) and/or the insulation units (120) and/or the insulation inserts (170). Other insulation, such as the planar insulation panels (190), may be added to the insulation layer (100). It may be that for some surfaces or for areas in which there are openings such as windows and doors, the insulation panels (220) may be more appropriate or less appropriate and the insulation units (120), insulation inserts (170) and planar panels (190) may be more or less appropriate for other applications. Moreover, some portions of surfaces may utilize the panels (220) while the other portions along a same wall may utilize a combination with the insulation units (120), insulation inserts (170) and planar insulation panels (190). It can further be appreciated that one face of a wall may be used with one combination of insulating elements while the other wall may have a different combination. It can further be appreciated that additional insulating layers may be added over the top of the insulation units (120), insulation inserts (170) and planar panels (190) and the insulating panels (220). The types of finishing layers may also vary depending on the application and use and the R-value needed to be obtained for the insulation system (100). For some conditions and applications, only a rain screen is needed and it may be advantages to use only insulation units (120) for a thinner profile and to provide open spaces for ventilation.

Although the panels (220) are useful for many applications, intermodal containers (1000) may be constructed irregularly due to welding beads, warping and other manufacturing defects so that an even on-center spacing may not be maintained. With such irregularities, some panels may need to be cut so the panels can spread apart or so the panels can slide together tightly. The use of individual insulation components (120), (170), (190) that fit into a corresponding single recess overcome issues with maintaining alignment of protrusions and corresponding recesses.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An insulation unit comprising:

insulating material having a cross-section with a first face and an opposite second face, the first face including a longitudinally extending planar first central section and first and second longitudinally extending planar slanted surfaces on opposite sides of the first central section, the first and second slanted surfaces extending obliquely from the first central section toward the second face; the second face having a longitudinally extending planar second central section and first and second opposite recessed surfaces on laterally opposite sides of the second central section and extending parallel to the second central section; the slanted surfaces forming an edge with corresponding ones of the recessed surfaces.

2. An insulation unit according to claim 1, further comprising a longitudinally extending stud member embedded in the insulating material.

3. An insulation unit according to claim 2, wherein the embedded stud member includes portions extending to a surface of the insulating material.

4. An insulation system comprising:

a plurality of insulation units according to claim 1.

5. An insulation system according to claims 4, further comprising a plurality of planar insulation elements configured to fit against the recessed surfaces and sides of the second central sections of corresponding spaced apart ones of the insulation units.

6. An insulation system according to claim 4, further comprising a second insulation unit, the second insulation unit having a quadrilateral cross section including a first face and an opposite second face, the second face being parallel to the first face.

7. An insulation system according to claim 4, further comprising an insulation panel, the insulation panel comprising:

a first face;

a second face;

a first end having a first coupling surface;

a second end opposite the first end, the second end having a second coupling surface configured to mate with the first coupling surface;

a first alignment portion on a top surface of the panel and a second alignment portion on a bottom surface of the panel, the second alignment portion being complementary to the first alignment portion;

the second face having a corrugated surface with a first surface parallel to the first face, a recessed second surface spaced apart from and parallel to the first surface, and third and fourth surfaces extending between the first surface and the second surface, the third and fourth surfaces being oblique to the first and second surfaces.

8. An intermodal container comprising:

a base;

a roof;

walls extending between the base and the roof, at least one of the walls having a corrugated surface;

a door;

a plurality of insulation units, each of the insulation units having a corrugated surface complementary to the corrugated surface of the intermodal container;

wherein the plurality of insulation units comprises a plurality of first insulation units, each of the first insulation units defining a longitudinal axis and comprising:

insulating material having a cross-section with a first face and an opposite second face, the first face including a longitudinally extending planar first central section and first and second longitudinally extending planar slanted surfaces on opposite sides of the first central section, the first and second slanted surfaces extending obliquely from the first central section toward the second face; the second face having a longitudinally extending planar second central section and first and second opposite recessed surfaces on opposite sides of the second central section and extending parallel to the second central section; the slanted surfaces forming an edge with corresponding ones of the recessed surfaces;

a plurality of planar insulation elements configured to fit against the recessed surfaces and sides of the second central sections of corresponding spaced apart ones of the first insulation units.

9. A longitudinal support element for an insulation panel, the support element comprising:

a first section having a substantially planar portion;

a second section having a substantially planar portion extending substantially parallel to the planar portion of the first section;

a third section extending between a center of a first face of the first section and a center of a first face of the second section; the third section including connecting elements and defining openings between the first section and the second section;

the second section have a second face opposite the first face and forming a plurality of spaced apart adhesive engagement portions;

the first section extending along an entire length of the support element, the second section being formed of a plurality of segments, each segment being formed by a portion of the second section and the corresponding connecting elements extending to the portion of the second section.

10. A longitudinal support element for an insulation panel according to claim 9, wherein the first section comprises a plurality of channels extending transverse to a longitudinal direction of the longitudinal support element and forming a plurality of segments.

* * * * *